US005699615A

United States Patent [19]

Chen

[11] Patent Number: 5,699,615

[45] Date of Patent: Dec. 23, 1997

[54] POCKET-KNIFE

[75] Inventor: Shun-fu Chen, Taipei Hsien, Taiwan

[73] Assignee: Chia Yi Enterprises Co., Taipei Hsien, Taiwan

[21] Appl. No.: 745,623

[22] Filed: Nov. 8, 1996

[51] Int. Cl.[6] ..... B26B 1/04

[52] U.S. Cl. ..... 30/160; 30/161; 30/267

[58] Field of Search ..... 30/155–161, 330–331, 30/267; 7/118–120

[56] References Cited

U.S. PATENT DOCUMENTS

| | | | |
|---|---|---|---|
| 2,685,735 | 8/1954 | Sorensen | 30/267 X |
| 3,486,227 | 12/1969 | Somervell | 30/267 X |
| 4,347,665 | 9/1982 | Glesser . | |
| 4,741,106 | 5/1988 | Yamagishi . | |
| 4,985,998 | 1/1991 | Howard . | |
| 5,095,624 | 3/1992 | Ennis | 30/161 |
| 5,546,662 | 8/1996 | Seber et al. | 30/160 X |

*Primary Examiner*—Douglas D. Watts
*Attorney, Agent, or Firm*—Beveridge, DeGrandi, Weilacher & Young, LLP

[57] ABSTRACT

Disclosed is a pocket-knife mainly including a handle consisting of two side members which together define a cavity at one side of the handle to receive a blade therein. The blade is pivotally connected at a rear portion to a front portion of the handle by a pivotal pin and can be extended from the handle to an open or operative position or be folded toward the handle to a closed or storage position. A releasable locking means is disposed between the two side members for locking the blade in the open position. The pocket-knife is characterized in several rotatable balls spaced around the pivotal pin and contacting with side surfaces of the rear portion of the blade, allowing the blade to be smoothly extended or folded with help of the rotatable balls. Two spring-supported compressing balls are further attached to the inner surfaces of the two side members such that the compressing balls engage with two ends of a round through hole formed on the rear portion of the blade when the blade is folded and received in the cavity of the handle, retaining the blade in the closed position without easily coming out of the handle even when the pocket-knife collides with something or falls accidentally.

4 Claims, 6 Drawing Sheets

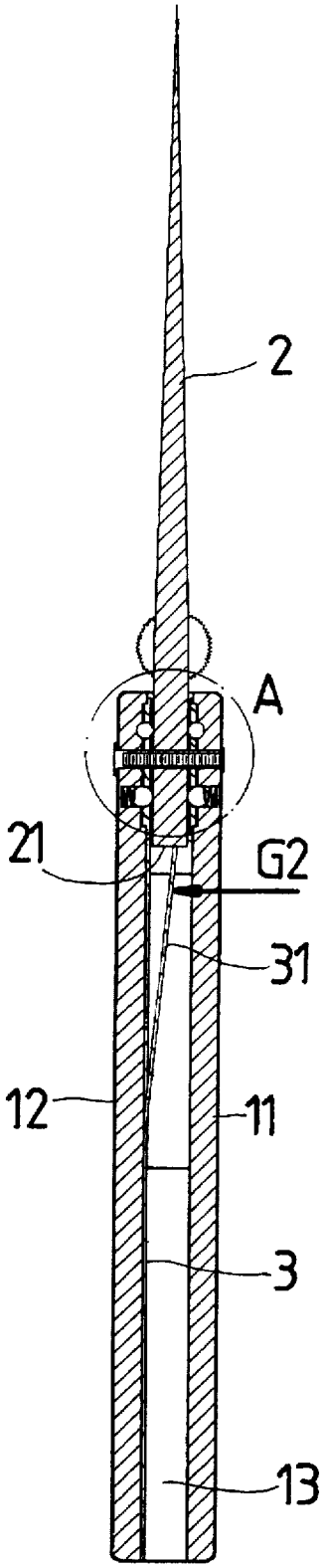
FIG. 5
FIG. 6
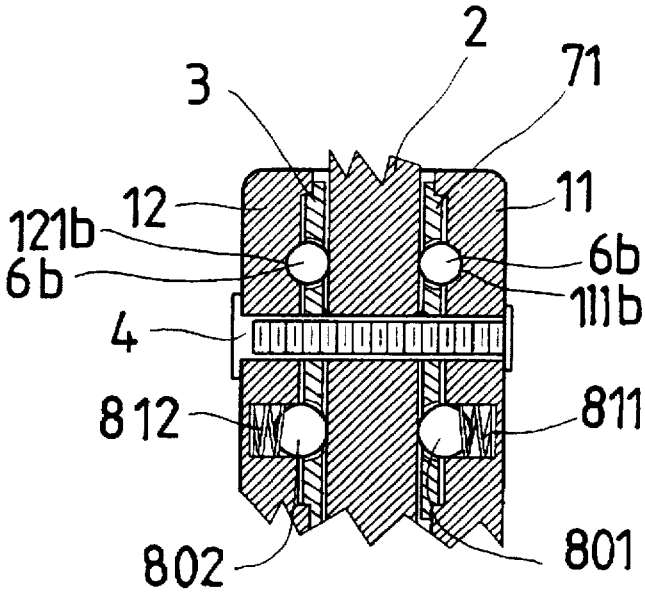

POCKET-KNIFE

FIELD OF THE INVENTION

The present invention relates to a pocket-knife with improved structure, and more particularly to a pocket-knife of which a blade can be smoothly folded or opened relative to a handle of the pocket-knife and the blade in a folded position is not easily released from the handle.

BACKGROUND OF THE INVENTION

There are many differently structured pocket-knives. For example, U.S. Pat. No. 4,347,665 to Glesser discloses a pocket-knife having a body including a pair of side portions separated by a spacer so as to define a storage cavity for a knife blade. The blade is pivotally carried by its end from a selected end of the body between a stored position and an open or operative position. A releasable lock mechanism operably carried on the body for retaining the blade in its open position. The blade is provided with a cutting edge along an underside and a cutting edge of shorter length is provided along the top side and a finger depression is formed on the blade adjacent to an enlarged portion for grasping by the thumb of the user for urging the blade from its closed position into its open or operative position.

U.S. Pat. No. 4,741,106 to Yamagishi discloses a folding pocket-knife substantially including a handle, a blade retaining lever and a blade. The blade is pivotally held in the handle wherein the engagement between a holding lever and the base of the blade, which keeps the blade out of the handle, is released by depressing the press area of the lever. The press area of the lever is covered with soft and pliable material that can be moved downward together with the press area so that the disengagement between the retaining lever and the blade can be made without pain to the finger. The whole body of the handle is covered with the soft and pliable material, but the handle may be formed with hard material except the portion over the press area so that this portion is covered with the soft and pliable material.

U.S. Pat. No. 4,985,998 to Howard discloses a knife having a foldable blade includes a locking bar which holds the blade in an open position. A release lever is provided on the side of the handle for releasing the locking bar and allowing the blade to be moved to a closed position. The release lever has a laterally exposed portion which is flush with the outer surface of a bolster of the knife and a projection which extends into the recess which receives the blade when the knife is closed. The projection engages the bottom surface of the locking bar and urges it upward when the laterally exposed portion is depressed.

Although the above-mentioned conventional pocket-knives have different structures, they all have to be operated with two hands. This is, of course, inconvenient for the user when the pocket-knives are small in volume. The pocket-knife disclosed in the patent to Glesser may also be operated with one hand. The blade thereof is, however, pivotally connected to the handle and will not be able to be turned into an open position if the blade is too tightly held in the storage cavity provided by the handle, and will easily and dangerously come into the open position from a closed position even under a minor touch if the blade is too loosely held in the handle. On the other hand, the engagement of the blade with the handle tends to become loose after being used for a long time.

SUMMARY OF THE INVENTION

It is therefore a primary object of the present invention to provide a pocket-knife in which several balls are rotatably and correspondingly provided to inner surfaces of two side members of a handle of the knife around a pivotal pin connecting the blade to the side members of the handle. The balls project from the inner surfaces of the side members and contact with two outer surfaces of the blade near its rear end. With these rotatable balls, the blade can be smoothly folded into or extended from the handle.

Another object of the present invention is to provide a pocket-knife in which two balls each supported by a spring are provided to inner surfaces of the two side members of the handle of the knife corresponding to a round hole formed near the rear end of the blade. Whereby, when the blade is in its folded position, the spring-supported balls just fall into the round hole on the blade. The springs firmly press the balls against the round hole and accordingly, the rear end of the blade, preventing the blade from easily moving out of the handle even when the knife collides with something or falls down from some higher position.

BRIEF DESCRIPTION OF THE DRAWINGS

The present invention can be best understood by referring to the following detailed description of the preferred embodiment and the accompanying drawings, wherein

FIG. 5 is a side sectional view of the present invention with the blade in an open position;

FIG. 6 is a fragmentary and enlarged sectional view taken on the circle A of FIG. 5, showing the contact of the balls with the blade near a rear end thereof.

DETAILED DESCRIPTION OF THE PREFERRED EMBODIMENT

Figure 1:
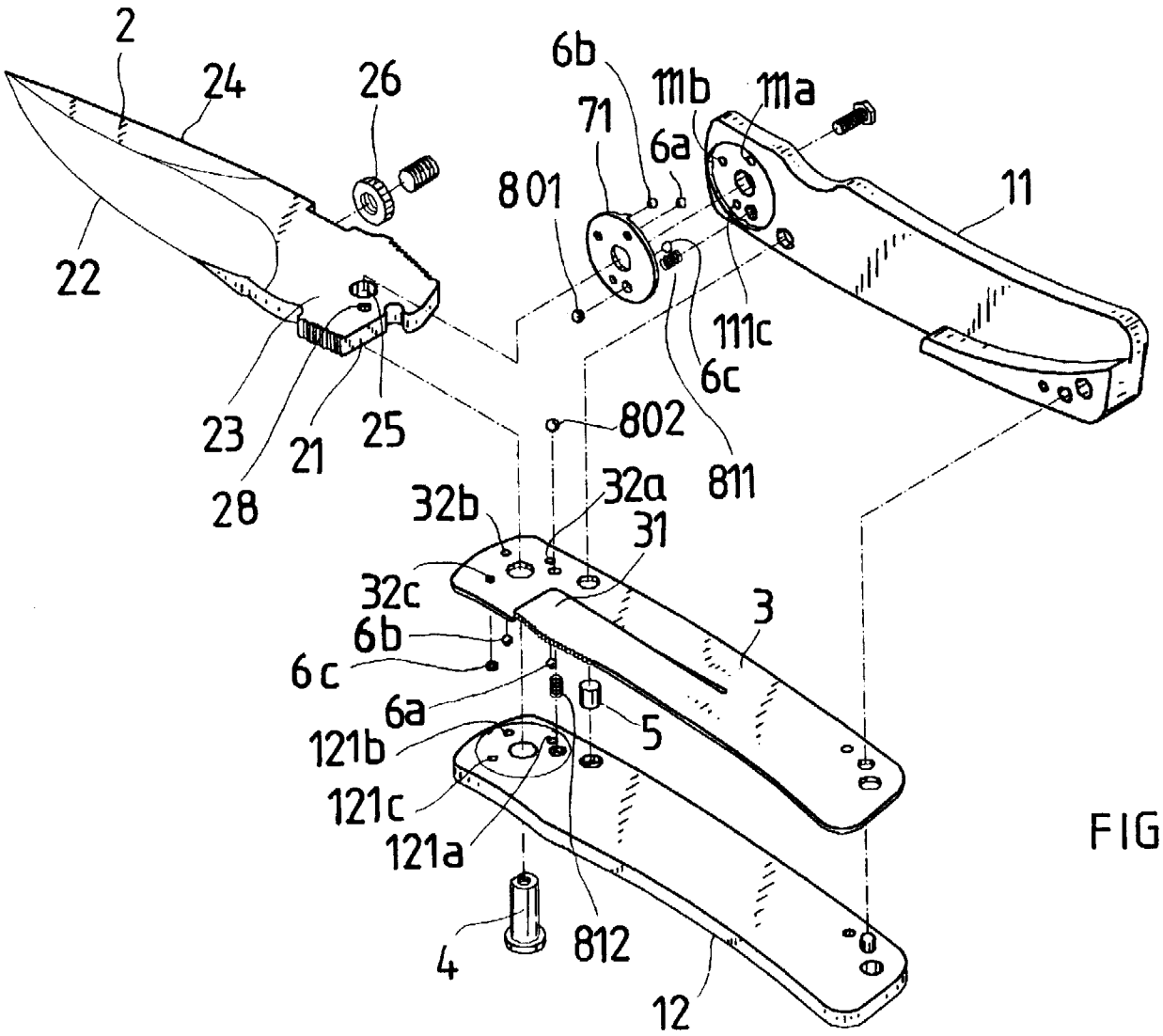
FIG. 1 is an exploded perspective of the pocket-knife of the present invention.
Figure 2:
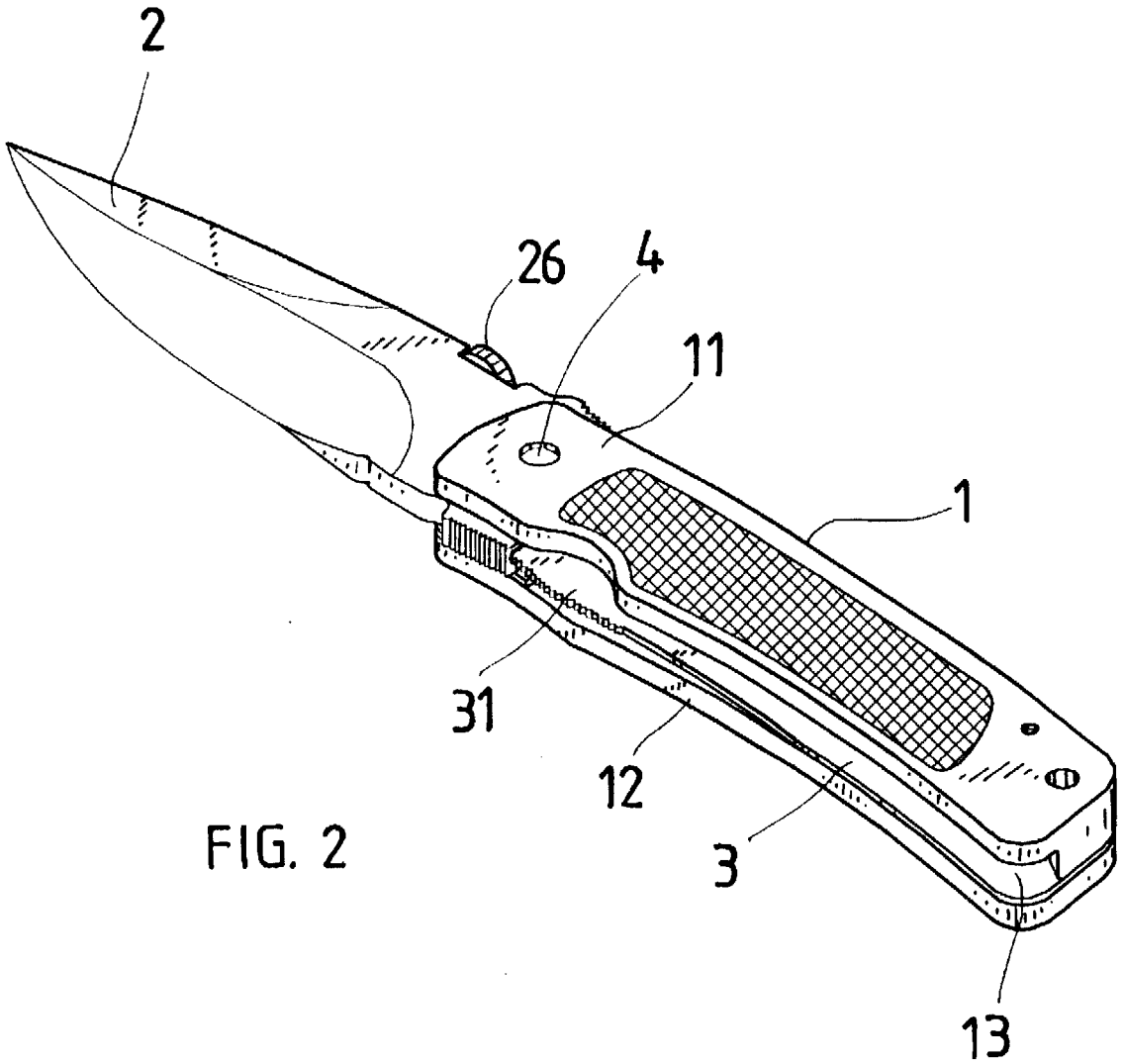
FIG. 2 is an assembled perspective of the pocket-knife of FIG. 1 with the blade in an open position.

Please refer to FIGS. 1 and 2. The present invention relates to a pocket-knife which mainly includes a handle 1 including a first side member 11 and a second side member 12, and a blade 2 pivotally connected at a rear portion 23 to a front portion of the handle 1 by means of a pivotal pin 4. A substantially flat locking means 3 is held between the first and the second side members 11, 12 with a part of it forming a spring leaf 31. The spring leaf 31 upward inclinedly extends forward with its front free end pressing against a rear end surface 21 of the blade 2 when the blade 2 is completely extended or opened relative to the handle 1, as shown in FIG. 2, permitting the blade 2 to be locked in an operative position. Please refer to FIG. 5, when the spring leaf 31 is depressed with a force in a direction as shown by arrow G2, it no longer presses against the blade 2 and the blade 2 is released from a locked state and can be folded with its cutting edge 22 received in a cavity 13 defined by the first and the second side members 11, 12 at one side of the handle 1, as shown in FIG. 3.

The pivotal pin 4 extends through holes formed at the front portion of the first and the second side members 11, 12 of the handle 1, and of the locking means 3, as well as a through pin hole 25 formed at the rear portion 23 of the blade 2, so that the blade 2 is pivotally connected to and between the first side member 11 and the locking means 3.

Figure 3:
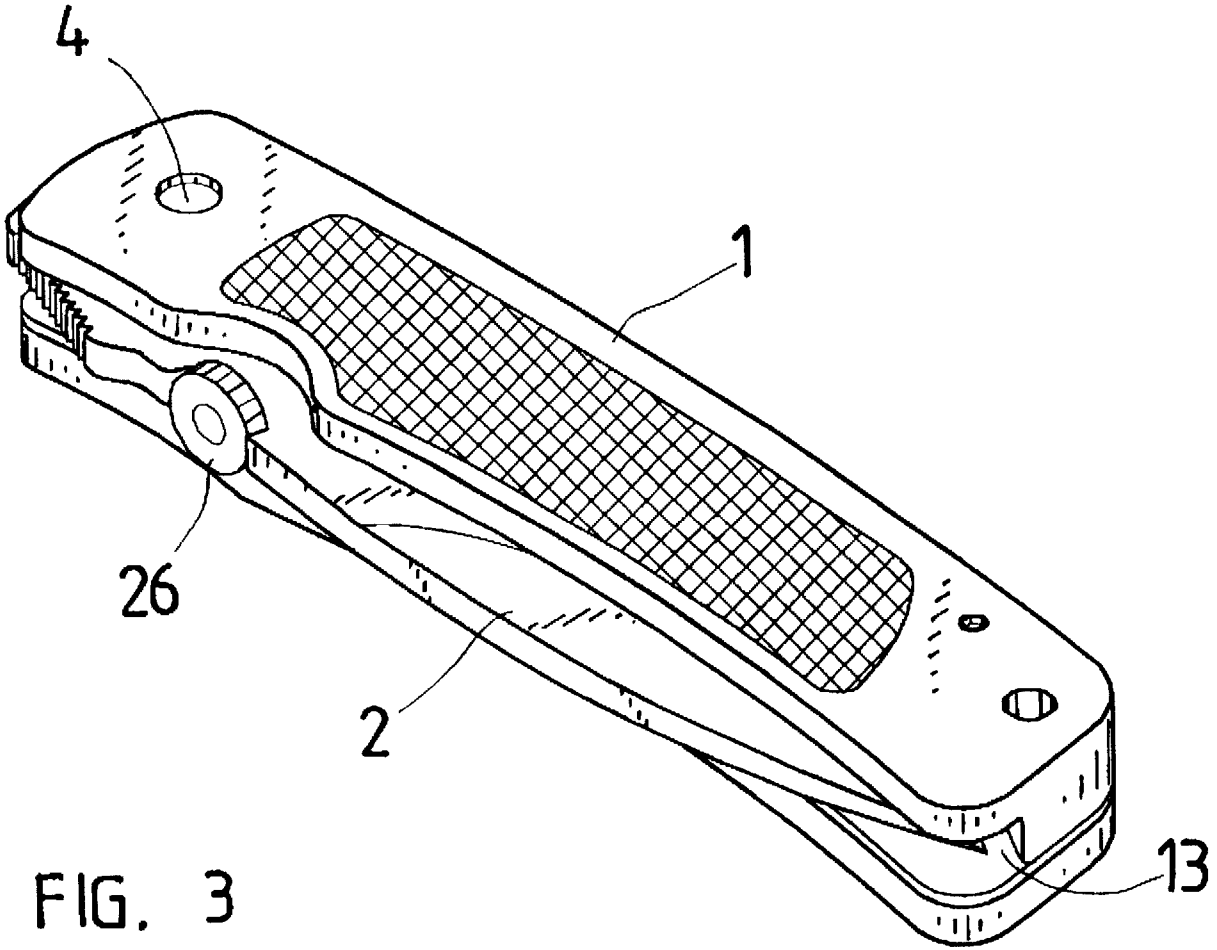
FIG. 3 is an assembled perspective of the pocket-knife of FIG. 1 with the blade in a folded position.
Figure 4:
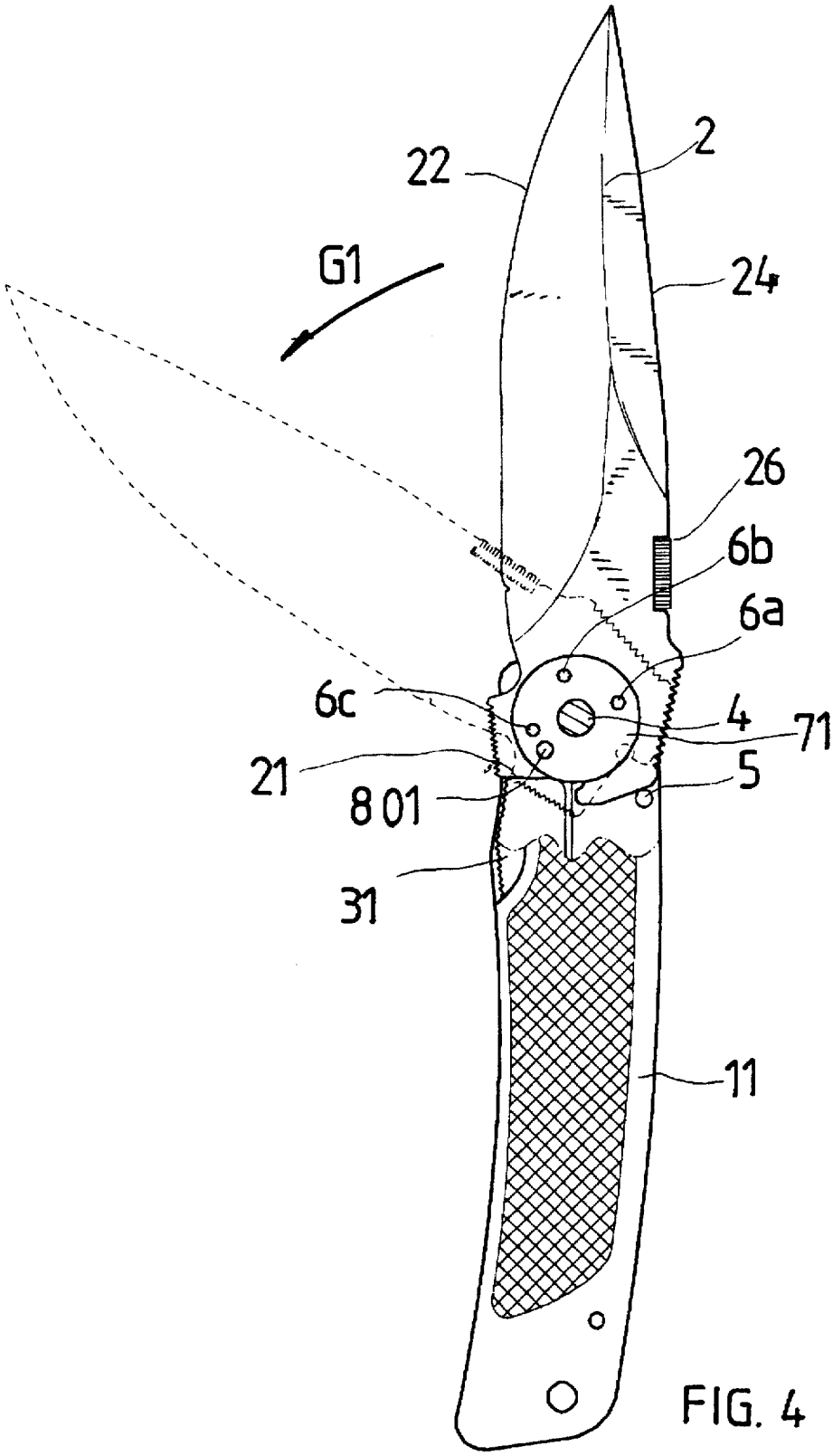
FIG. 4 is a front elevational view of the present invention with the blade in an open position.
Figure 7:
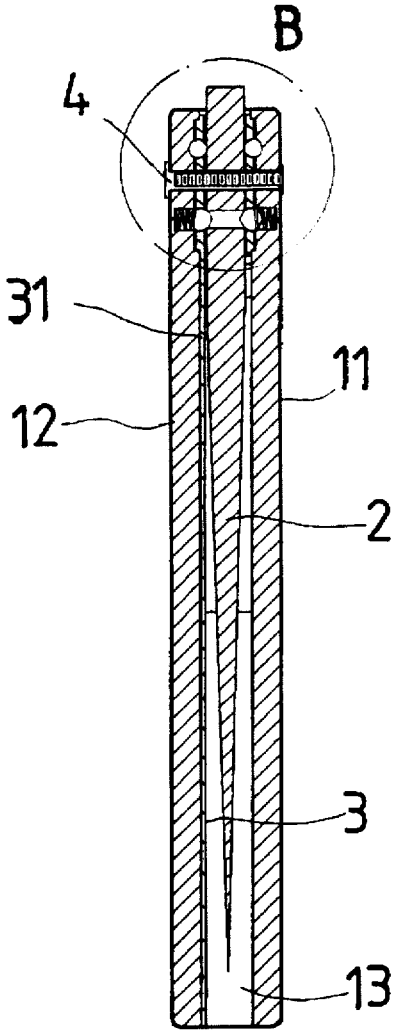
FIG. 7 is a side sectional view of the present invention with the blade in a folded position.

When the spring leaf 31 of the locking means 3 no longer presses against the rear end surface 21 of the blade 2, the blade 2 is allowed to be turned about the pivotal pin 4 in a direction as shown by the arrow G1 in FIG. 4 until the blade 2 is completely folded and received in the cavity 13 at one side of the handle 1, as shown in FIG. 3. The blade 2 is provided at a back side 24 opposite to its cutting edge 22 with a button 26 which forms an enlarged area on the back side 24 of the blade 2 for a user to operate the pocket-knife with a thumb more conveniently. A stopper 5 is disposed and extending between the first and the second side members 11, 12, such that it abuts against the rear end surface 21 of the blade 2 near the back side 24 when the blade 2 is in an open and operative position, as shown in FIG. 4, preventing the blade 2 from over turned. The stopper 5 and the spring leaf 31 together hold the extended blade 2 in place for stable operation.

Please now refer back to FIG. 1. Three concave dents 111*a*, 111*b*, 111*c* are formed on the inner surface of the first side member 11 around the hole through which the pivotal pin 4 extends. And, three concave dents 121*a*, 121*b*, 121*c* are formed on the inner surface of the second side member 12 corresponding to the dents 111*a*, 111*b*, 111*c*, respectively. Each of the concave dents is capable of receiving a lower hemisphere of a ball 6*a*, 6*b*, or 6*c*. Three through holes 32*a*, 32*b*, 32*c* are formed on the locking means 3 at positions corresponding to the dents 111*a*, 121*a*; 111*b*, 121*b*; and 111*c*, 121*c*. The set of balls 6*a*, 6*b*, 6*c* disposed in the concave dents 121*a*, 121*b*, 121*c* emerge from the holes 32*a*, 32*b*, 32*c*. A washer 71 is disposed between the blade 2 and the first side member 11 near the rear portion 23 of the blade 2 with a central through hole thereof aligning with the pin hole 25. The washer 71 functions similar to the front portion of the locking means 3, that is, to prevent the set of balls 6*a*, 6*b*, 6*c* disposed in the dents 111*a*, 111*b*, 111*c* from falling out of the dents while allowing them to rotate in the dents. This permits the blade 2 to be extended from or folded into the handle 1 in a more smooth manner.

Figure 8:
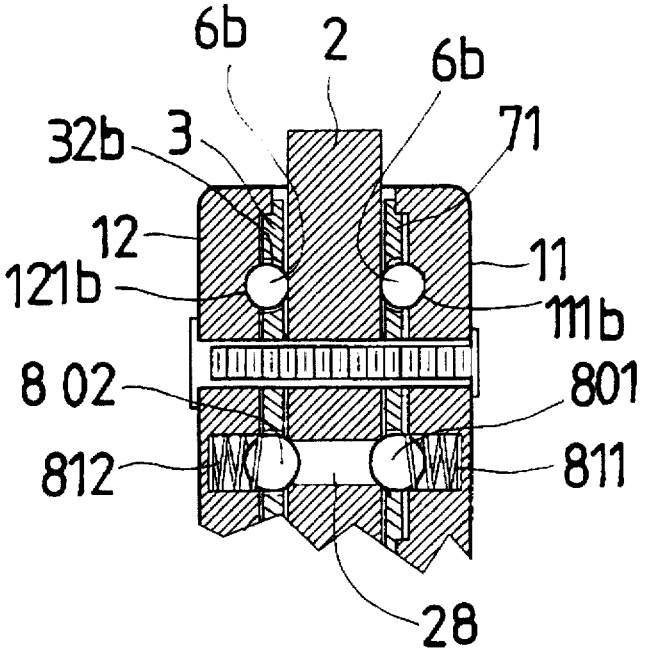
FIG. 8 is a fragmentary and enlarged sectional view taken on the circle B of FIG. 7, showing the spring-supported balls falling into and pressed against the blade near the rear end thereof.

Two compressing balls 801, 802 being supported on two springs 811, 812, respectively, are disposed in two holes formed on the inner surfaces of the first and the second side members 11, 12 slightly behind the dents 111*a*, 121*a*; 111*b*, 121*b*; 111*c*, 121*c*. The balls 801, 802 are retained in place by the washer 71 and the locking means 3, respectively, as shown in FIG. 6. As shown, there are also holes formed on the washer 71 and the locking means 3 corresponding to the balls 801, 802, allowing the balls 801, 902 to protrude beyond the washer 71 and the locking means 3 under the spring force of the springs 811 and 812. When the blade 2 is folded and received in the handle 1, the balls 801, 802 protruding beyond the washer 71 and the locking means 3 shall engage with two ends of a round through hole 28 formed on the rear portion 23 of the blade 2, as shown in FIG. 8, firmly hold the blade 2 between them. Whereby, the folded blade 2 is located in place and will not easily become loose from the handle 1 even when it collides with something or falls accidentally.

With the above arrangements, the pocket-knife according to the present invention is characterized in the multiple balls 6 rotatably provided around the pivotal pin 4 when the blade 2 and the first and the second side members 11, 12 are assembled to form the pocket-knife. The balls 6 function like ball bearings to permit the blade 2 to be turned about the pivotal pin 4 relative to the handle 1 smoothly. The present invention is also characterized in the two spring-supported compressing balls 801, 802. These two compressing balls 801, 802 fitly engage with the round through hole 28 of the blade 2 when the blade 2 is folded and received in the handle between the first and the second side members 11, 12, preventing the folded blade 2 from easily coming out of the handle 1 even when the pocket-knife collides with something or falls accidentally. The pocket-knife of the present invention can therefore be smoothly extended for operation or be firmly folded without being easily and dangerously opened under collision or falling. It is much better than the conventional ones in its structure.

What is to be noted is the three balls 6*a*, 6*b*, 6*c* as illustrated in the present invention allow the pocket-knife of the present invention to be extended or folded in three stages. However, the balls for such purpose can be fewer or more than three, depending on the actual need.

What is claimed is:

1. A pocket-knife allowing to be extended to an operative position or be folded to a storage position in more than one stage, comprising:

a handle including a first and a second side members which together define a cavity between them at one side of said handle;

a blade pivotally connected at a rear portion to a front portion of said handle by means of a pivotal pin, allowing said blade to be turned about said pivotal pin relative to said handle to an open or operative position or to a closed or storage position; and a locking means disposed between said first and said second side members of said handle to lock said blade in place when said blade is in said open or operative position or to release said blade from said open or operative position through a depression of said locking means, so that said blade can be folded and received into said cavity of said handle;

wherein said first and said second side members have a plurality of rotatable balls attached to inner surfaces of said first and said second side members around said pivotal pin, and said rotatable balls contacting with two side surfaces of said blade, allowing said blade to be opened or closed smoothly.

2. A pocket-knife as claimed in claim 1, wherein said first and said second side members are further provided at said inner surfaces with a spring-supported compressing ball each to correspond to a round through hole formed on the blade, whereby when said blade is folded and received in said handle, said spring-supported compressing balls engage with two ends of said round through hole on said blade to firmly hold said blade in said handle.

3. A pocket-knife as claimed in claim 1, wherein said first and said second side members are provided at said inner surfaces with concave dents to each receive one of said rotatable balls therein, and wherein a washer is disposed between said inner surfaces of said first and said second side members and said two side surfaces of said blade near a rear portion of said blade to retain but allow said rotatable balls to rotate in said concave dents.

4. A pocket-knife as claimed in claim 3, wherein said locking means is a flat plate and is formed with through holes corresponding to said rotatable balls and said compressing balls, such that said balls respectively protrude beyond said through holes, and wherein said locking means has a part forming an upward inclined spring leaf, said spring leaf pressing a free end against a rear end of said blade and thereby locking said blade in said open or operative position, and, said blade being released from said locked position when said spring leaf is depressed.

* * * * *